US006543666B1

(12) United States Patent
Huang

(10) Patent No.: US 6,543,666 B1
(45) Date of Patent: Apr. 8, 2003

(54) COMBINATION OF CAP FEEDING DEVICE AND STAPLE GUN

(76) Inventor: Chen-Fa Huang, No. 441-2, Ta Li Rd., Tai Li City, Taichung Hsien (TW)

( * ) Notice: Subject to any disclaimer, the term of this patent is extended or adjusted under 35 U.S.C. 154(b) by 0 days.

(21) Appl. No.: 10/045,162

(22) Filed: Jan. 15, 2002

(51) Int. Cl.[7] ..... B25C 7/00

(52) U.S. Cl. ..... 227/18; 227/119; 227/136; 221/197

(58) Field of Search ..... 227/15, 18, 120, 227/130, 119, 136, 138; 221/197, 198, 297, 289

(56) References Cited

U.S. PATENT DOCUMENTS 3,595,460 A * 7/1971 Pitkin ..... 227/130
5,056,684 A * 10/1991 Beach et al. ..... 227/120
5,791,546 A * 8/1998 McGuinness et al. ..... 227/119
5,921,454 A * 7/1999 Iarson et al. ..... 227/18
6,065,660 A * 5/2000 Cabrera ..... 227/18
6,273,315 B1 * 8/2001 McGuinness et al. ..... 227/119

* cited by examiner

*Primary Examiner*—Scott A. Smith
(74) *Attorney, Agent, or Firm*—Rosenberg, Klein & Lee

(57) ABSTRACT

A The present invention relates to a staple gun with a cap feeding device connected to a nose portion of the barrel of the staple gun. A cap container is located beside and in parallel with the barrel. A transportation member is connected between the cap container and the nose portion of the staple gun. A distance between the cap container and the nose portion is substantially only one diameter distance of the cap.

1 Claim, 3 Drawing Sheets

COMBINATION OF CAP FEEDING DEVICE AND STAPLE GUN

FIELD OF THE INVENTION

The present invention relates to a combination of a staple gun and a cap feeding device which includes a cap container located beside and in parallel with the barrel. Only one diameter distance of the cap A distance between the cap container and the nose portion is equal to a diameter of a cap.

BACKGROUND OF THE INVENTION

A conventional combination of a staple gun and a cap feeding device known to applicant is disclosed in U.S. Pat. No. 6,302,310 to Lamb with a title of "Staple Or Nail Gun Assembly, Cap Feeding Device For Staple Or Nail Gun, And Cap Assembly". The assembly includes a container for receiving the caps and the container is fixedly connected to a rear end of the handle of the staple gun. A base is connected between the lower end of the container and the nose portion of the staple gun. The caps are filled in the passage in the base and moved by a pneumatic device so that the caps are fed into the cap holding chamber located beneath of the nose portion of the staple gun one cap at a time. The position of the container makes the whole assembly to be bulky and the passage is so long that at least six caps are filled in the passage before entering into the cap holding chamber. It is possible that the six caps in the passage are jammed or stocked during pushing by the pneumatic device. Because there are two rails on two sides of the passage so as to prevent the caps from being dropping from the passage, it takes time to release the trouble.

The present invention intends to provide a short base wherein only one cap is filled between the nose portion and the cap container.

SUMMARY OF THE INVENTION

In accordance with one aspect of the present invention, there is provided a device for feeding caps to a staple gun and the device comprises a base which has a first end thereof connected to a nose portion of the staple gun and a passage is defined in a top surface of the base. A cap container for storing caps is vertically connected to the top surface of the base and is located beside and in parallel with the barrel of the staple gun. A distance between a lower end of the cap container and the first end of the base substantially equals to a diameter of a cap. A pneumatic device is connected to the staple gun and a push plate is movably received in the passage and driven by the pneumatic device.

The primary object of the present invention is to provide a staple gun having a cap feeding device wherein the distance from the cap container to the nose portion of the staple gun is short so as to reduce risks of jamming of the caps.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
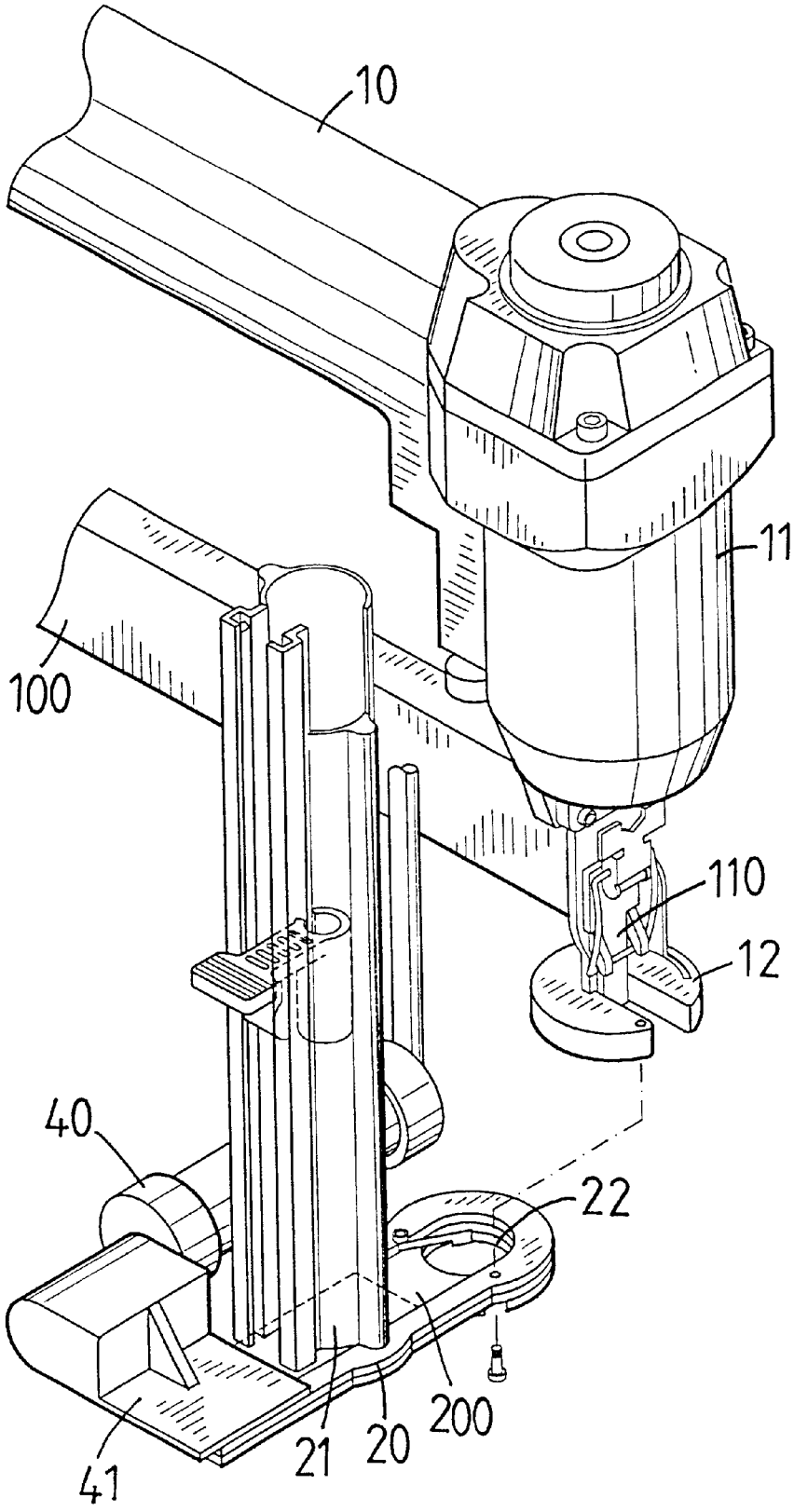
FIG. 1 is an exploded view to show the staple gun and the cap feeding device of the present invention.
Figure 2:
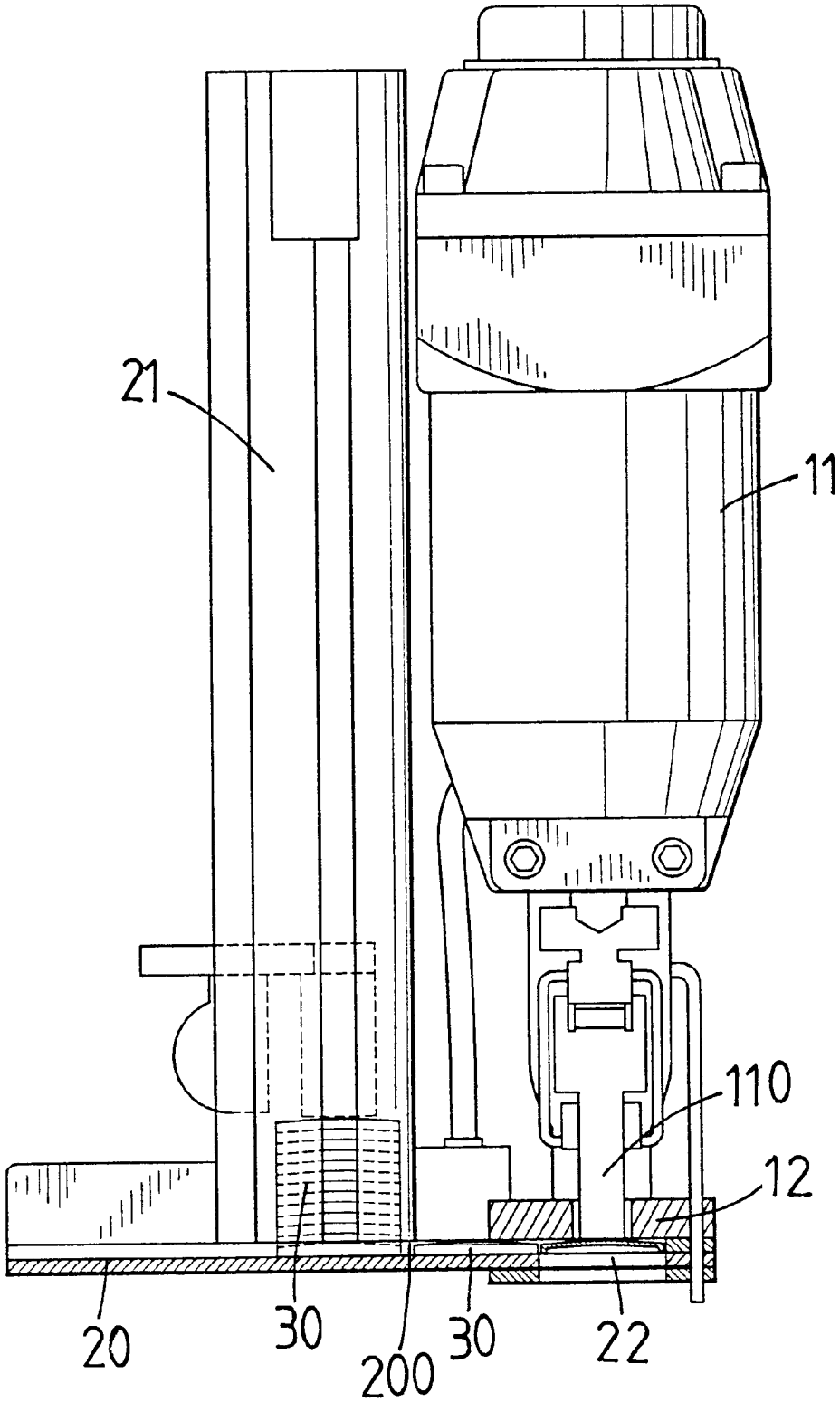
FIG. 2 is a cross sectional view to show the assembly of the staple gun and the cap feeding device of the present invention.
Figure 3:
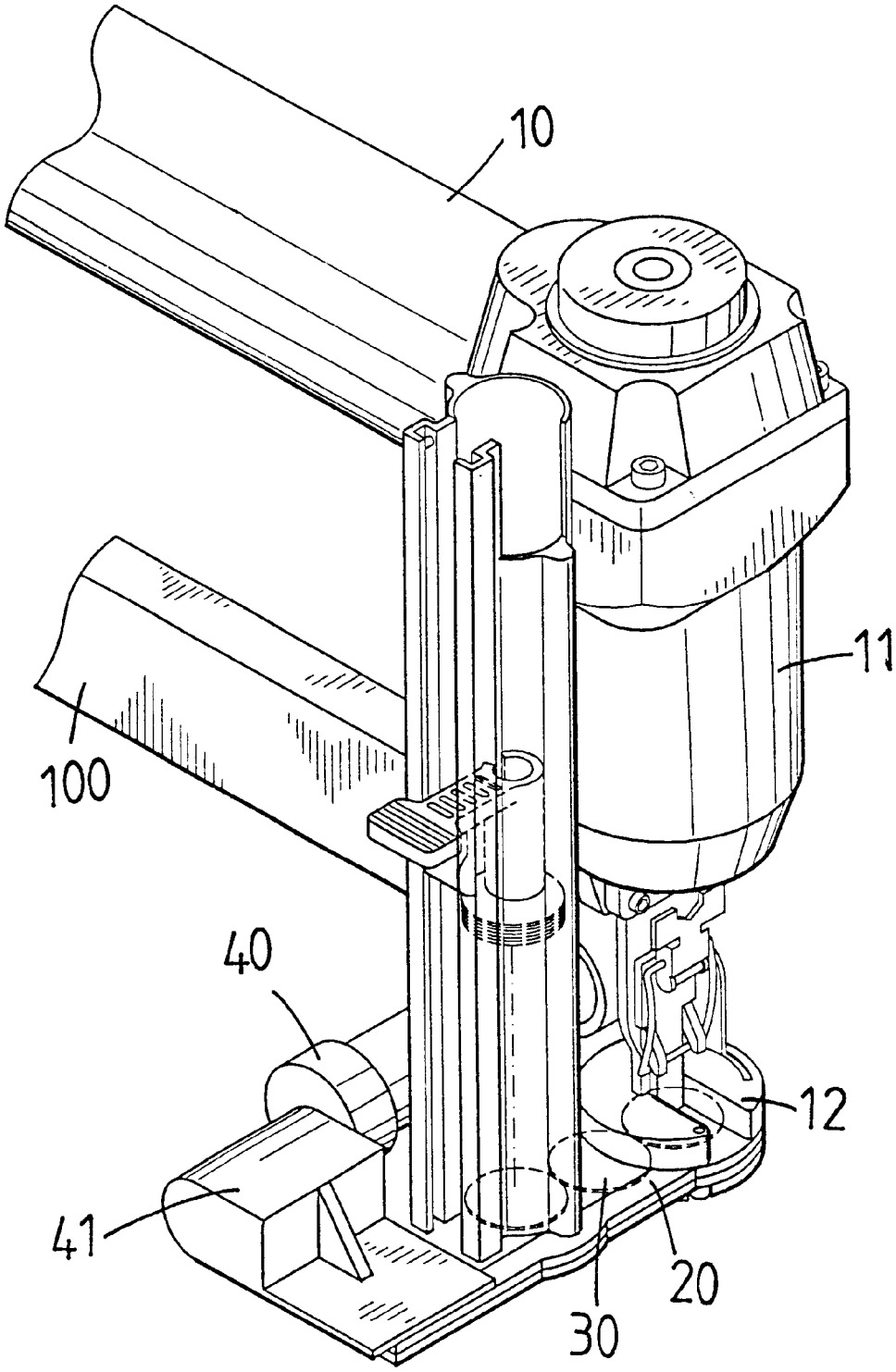
FIG. 3 is a perspective view to show the staple gun and the cap feeding device of the present invention.

Referring to FIGS. 1 to 3, the staple gun of the present invention comprises a handle 10 and a barrel which is connected to the handle 10 and has a nose portion 110 from which a staple or nail is ejected. A magazine 100 for receiving staples or nails is connected to the barrel 11. A circular holding member 12 is connected to the nose portion 110 and includes a recess for the staples or nails ejecting therethrough.

A cap feeding device comprises a base 20 which has a first end engaged with the holding member 12 and a second end of the base 20 is connected to a cover 41 of a pneumatic device 40. A passage 200 IS defined in a top surface thereof and two rails extend from two sides of the base 20 so as to prevent the caps 30 from dropping from the passage 200. A cap container 21 for storing the caps 30 is vertically connected to the top surface of the base 20 and the cap container 21 is located beside and in parallel with the barrel 11 of the staple gun. A lower open end of the cap container 21 communicates with the passage 200 so that a cap 30 can be positioned in the passage 200 and pushed by a push plate (not shown) of the pneumatic device 40. The push plate is movably received in the passage 200 and covered by the cover 41.

A cap holding zone 22 is defmed in the first end of the base 20 and communicates with the recess of the holding member 12. The cap holding zone 22 is located beneath the nose portion 110 of the staple gun such that a nail ejecting from the nose portion 110 may extend through the cap 30 in the cap holding zone 22. A distance between the lower open end of the cap container 21 and the cap holding zone 22 substantially equals to a diameter of a cap 30.

While we have shown and described the embodiment in accordance with the present invention, it should be clear to those skilled in the art that further embodiments may be made without departing from the scope of the present invention.

What is claimed is:

1. A device for feeding caps to a staple gun which includes a barrel with a nose portion from which a staple or nail is ejected, a holding member connected to the nose portion, the device comprising:

a base having a passage defined in a top surface thereof and a cap container for storing caps being vertically connected to the top surface of the base, two-rails extending from two sides of the base so as to prevent the caps from dropping from the passage, the cap container adapted to be located beside and in parallel with the barrel of the staple gun, a cap holding zone defined in a first end of the base and including an enclosed end, a top surface of the enclosed end being in flush with the two rails, the cap holding zone adapted to be located beneath the nose portion of the staple gun, a distance between a lower end of the cap container and the cap holding zone being substantially a diameter of a cap, a pneumatic device adapted to be connected to the staple gun and having a cover connected to a second end of the base, a push plate movably received in the passage and driven by the pneumatic device, the first end of the base adapted to be engaged with the holding member.

* * * * *